United States Patent [19]

Kuwajima et al.

[11] 4,165,839

[45] Aug. 28, 1979

[54] METHOD FOR DISINTEGRATING MICA FLAKES AND APPARATUS USED THEREFOR

[75] Inventors: Hideji Kuwajima, Hitachi; Hirofumi Mizoguchi, Kasuga; Juichi Sakurada; Takeyoshi Watanabe, both of Hitachi, all of Japan

[73] Assignee: Hitachi Chemical Company, Ltd., Tokyo, Japan

[21] Appl. No.: 897,691

[22] Filed: Apr. 19, 1978

[51] Int. Cl.[2] ..... B02C 19/06

[52] U.S. Cl. ..... 241/4; 241/20; 241/39; 241/79.1

[58] Field of Search ..... 241/4, 5, 20, 24, 38, 241/39, 46 R, 79.1, 97

[56] References Cited

U.S. PATENT DOCUMENTS

| | | | |
|---|---|---|---|
| 2,490,129 | 12/1949 | Heyman | 241/39 X |
| 3,162,381 | 12/1964 | Cohn et al. | 241/5 X |
| 3,206,127 | 9/1965 | Morris et al. | 241/4 |
| 3,719,329 | 3/1973 | Ruzicka | 241/5 X |

*Primary Examiner*—Roy Lake
*Assistant Examiner*—E. F. Desmond
*Attorney, Agent, or Firm*—Craig and Antonelli

[57] ABSTRACT

Mica flakes are disintegrated to mica scales having a diameter of 10 mm or less and a ratio of diameter/thickness of 100–1000 by using an apparatus and a method comprising bringing about coarse size reduction followed by size reduction of the mica flakes by high-pressure jets of water, if desired together with high-pressure jets of gas, separating mica scales from mica flakes by vertical classification followed by horizontal classification, and taking out the mica scales as a slurry while recycling nondisintegrated mica flakes to size reduction. The slurry of mica scales is used for making mica paper.

7 Claims, 3 Drawing Figures

METHOD FOR DISINTEGRATING MICA FLAKES AND APPARATUS USED THEREFOR

BACKGROUND OF THE INVENTION

This invention relates to a method for producing mica scales by size reduction of mica flakes and an apparatus used therefor. More particularly, this invention relates to a method for reducing in size of mica flakes continuously and economically effectively to mica scales having the desired thickness and particle size distribution and an apparatus used therefor.

Heretofore, various methods for producing mica scales have been proposed, for example, in Japan Pat. application Kokoku (Post-Exam. Publn.) No. 15351/60, U.S. Pat. Nos. 2,405,576 and 3,608,835, etc.

The method disclosed in Japan Pat. application Kokoku (Post-Exam. Publn.) No. 15351/60 is a method for disintegrating calcined mica which comprises heating mica flakes so as to partially remove the water of crystallization but not the whole at 700°–900° C. in order to expand the volume between the layers of a mica flake (hereinafter referred to as "volume expansion" or "volume expanded"), dipping the volume expanded mica flakes in water or an aqueous solution of an acid or an alkali (hereinafter referred to as "an aqueous solution") as they are at high temperatures or after cooling, and stirring the aqueous solution in order to disintegrate the mica flakes to mica scales having 1μ or less in thickness by the mechanical force of the aqueous solution. The apparatus used for this method is shown in FIG. 1. According to this method, the volume expanded mica flakes 6 fed together with water from a raw material feed section 2 into a disintegration tank 1 are disintegrated by a stirrer 7 for a long period of time, and mica scales 5 having a smaller size than the opening in a perforated plate 4 at the overflow section can be obtained from a overflow pipe 3 in the form of mica scale suspension. But this method has a fatal defect in that it is very difficult to conduct a stable continuous operation without improving the apparatus for preventing closing of the perforated plate 4, since the volume expanded mica flakes or larger mica scales easily close the perforated plate 4 at the overflow section. Therefore, this method has many defects in that mass productivity is poor, much more steps are necessary and economy of the process is very poor. In addition, according to this method, it is possible to disintegrate volume expanded mica flakes 6, but it is impossible to disintegrate non-volume expanded mica flakes to mica scales. Thus, there are many problems in this method in that it is necessary to calcine mica flakes for volume expansion, thickness and particle size distribution of the resulting mica scales are changed depending on the degree of calcining, i.e., the degree of volume expansion, in case of some kinds of mica flakes, the components are oxidized during the calcining resulting in remarkable decrease in mechanical strengths, and the like.

The method disclosed in U.S. Pat. No. 2,405,576 comprises using an "8" shaped disintegration tank having an upper chamber and a lower chamber connected by an intermediate section, charging mica flakes in the lower chamber, introducing high-speed jets of water from nozzles at the intermediate section to the lower chamber to disintegrate the mica flakes, and taking out the resulting disintegrated mica scales from the upper chamber. This method has various defects due to the structure of the disintegration tank in that once produced thinly delaminated mica scales having a large size are further disintegrated to smaller particles having a small ratio of diameter to thickness during the residence in the lower chamber and the upper chamber by beat against one another or against mica flakes resulting in decrease in mechanical and electrical properties; since the disintegration tank has no classification effect, large mica flakes are taken out of the tank together with the disintegrated mica scales, which gives various problems in producing mica paper; and the like.

U.S. Pat. No. 3,608,835 discloses a method for producing mica scales by using a disintegration tank of an inverted truncated cone shape having at the bottom agitating blades which coarsely disintegrate mica flakes by revolution, and having at the side wall an ultrasonic generator which disintegrates the coarsely disintegrated mica flakes to mica scales by ultrasonic energy. In this method, desirably disintegrated mica scales are taken out of the disintegration tank together with overflowing water and large mica flakes are disintegrated again in the tank. But since the disintegration tank has no sufficient classification effect, large mica flakes are often taken out of the tank together with mica scales by overflow; this is a fatal defect of this method.

Mica scales of several microns or less in thickness obtained by disintegrating mica flakes by these methods mentioned above are dispersed in water and mica paper is made from said pulp-like mica scale suspension or slurry by using a modified paper machine followed by dehydration and drying. Since mica paper is made by reconstituting mica scales in foil or sheet, it is also named as reconstituted mica sheet.

According to the conventional methods as mentioned above, large or thick insufficiently disintegrated mica scales are inevitably present in desirably thinly disintegrated mica scales, so that these mica scales are not suitable for producing mica paper. Thus, it is necessary to classify the slurry discharged from a disintegration tank in another step. Further, since disintegration tanks having insufficient classification effect are used in the conventional methods as mentioned above, thinly and largely disintegrated mica scales are ground to small particles during disintegration in the tank; this is not a desirable disintegration method.

In addition, the conventional methods as mentioned above have also a defect in that these methods cannot be applied to all mica flakes of non-calcined phlogopite, non-calcined muscovite and calcined muscovite.

SUMMARY OF THE INVENTION

It is an object of this invention to provide a method for producing mica scales by reducing in size of mica flakes continuously and economically overcoming the defects of the conventional methods as mentioned above. It is another object of this invention to provide an apparatus for producing such mica scales according to the above-mentioned method.

This invention provides a method for producing mica scales reduced in size from mica flakes which comprises bringing about coarse size reduction followed by size reduction of mica flakes by high-pressure jets of water, if desired together with high-pressure jets of gas, separating mica scales from mica flakes by vertical classification followed by horizontal classification, and taking out the mica scales as a slurry while recycling nondisintegrated mica flakes to size reduction.

This invention also provides an apparatus for the size reduction of mica flakes to produce mica scales comprising a coarse size reduction zone and a size reduction zone connected thereto, both zones installing nozzles for introducing high-pressure jets of water in order to disintegrate the mica flakes, a vertical classification zone wherein the mica flakes and mica scales moved from the size reduction zone are separated along an upward stream of water, a horizontal classification zone connected to the vertical classification zone wherein the mica scales are separated from the mica flakes along a horizontal stream of water, and a settling zone wherein nondisintegrated mica flakes settled from the horizontal classification zone are returned to the size reduction zone. The apparatus may further contain nozzles for introducing high-pressure jets of gas in the size reduction zone.

DETAILED DESCRIPTION OF THE INVENTION

In this invention, the term "mica scale" is used to denote mica platelets having a diameter of about 10 mm or less and a ratio of diameter/thickness being about 100–1000, preferably about 200–1000.

These mica scales are used for making mica paper or reconstituted mica sheet by using a paper machine and if necessary together with bonding agents.

The mica flakes used in this invention as a starting material are those having a diameter of more than about 10 mm or those having a diameter of about 10 mm or less and a ratio of diameter/thickness being less than 100. The mica flakes may be either natural or synthetic ones, either block or scrap mica. It is not necessary to calcine raw mica flakes. Any kinds of mica can be used as a starting material.

In the coarse size reduction zone, mica flakes are disintegrated coarsely by high-pressure jets of water introduced through one or more nozzles installed at the side wall (or walls) of the zone.

The mica flakes are further reduced in size in the size reduction zone connected to the coarse size reduction zone by high-pressure jets of water introduced through two or more nozzles installed at the side wall (or walls) of the zone.

Water pressure jetted from the nozzles installed at both the coarse size reduction zone and the size reduction zone is preferably 10–100 kg/cm$^2$, more preferably 20–50 kg/cm$^2$.

The size reduction zone may further install one or more nozzles preferably at the bottom of the zone, through said nozzles high-pressure jets of gas being introduced to the size reduction zone in order to accelerate the size reduction, to prevent closing of the passages by mica flakes, and to impart other advantages. As the gas, such an inert gas as nitrogen, carbon dioxide, etc., can preferably be used and air can also be used without giving any troubles. It is desirable that the gas contains no impurities such as a compressor oil or the like.

Gas pressure jetted from the nozzles is preferably 2–30 kg/cm$^2$, more preferably 4–20 kg/cm$^2$.

In the vertical classification zone, separation of mica flakes and mica scales obtained by disintegrating mica flakes forced up by the water stream or both the water stream and the gas stream is conducted by applying the fact that smaller mica scales are forced up higher than mica flakes and larger mica flakes remain at a lower place.

In the horizontal classification zone, mica scales and a small amount of mica flakes after the vertical classification are separated by moving them horizontally by the water stream, while mica flakes having larger settling velocity sink to the settling zone.

The mica scales separated from mica flakes are taken out of the apparatus as a slurry.

The mica flakes sunk to the settling zone are returned to the size reduction zone.

The method of this invention and the apparatus used therefor are explained in more detail by using the accompanying drawings.

Figure 1:
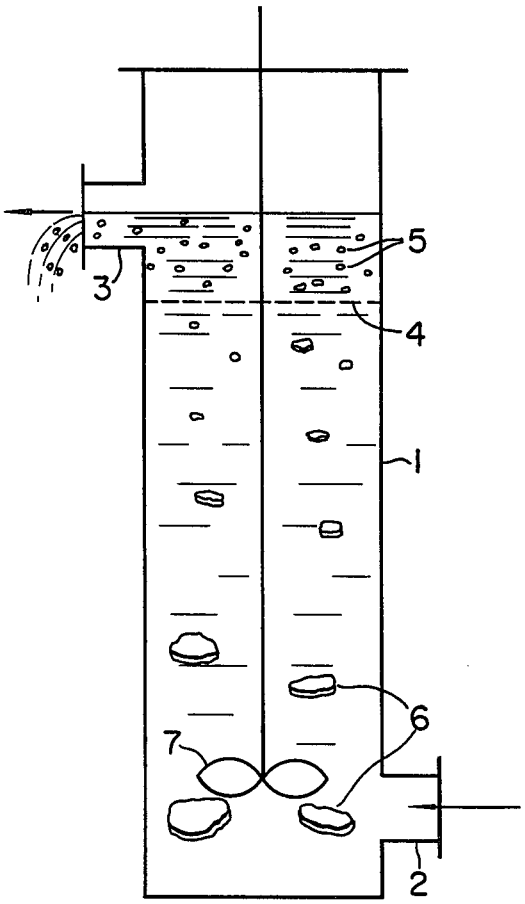
FIG. 1 is a longitudinal sectional view of the apparatus disclosed in Japan Pat. application Kokoku No. 15351/60.
Figure 2:
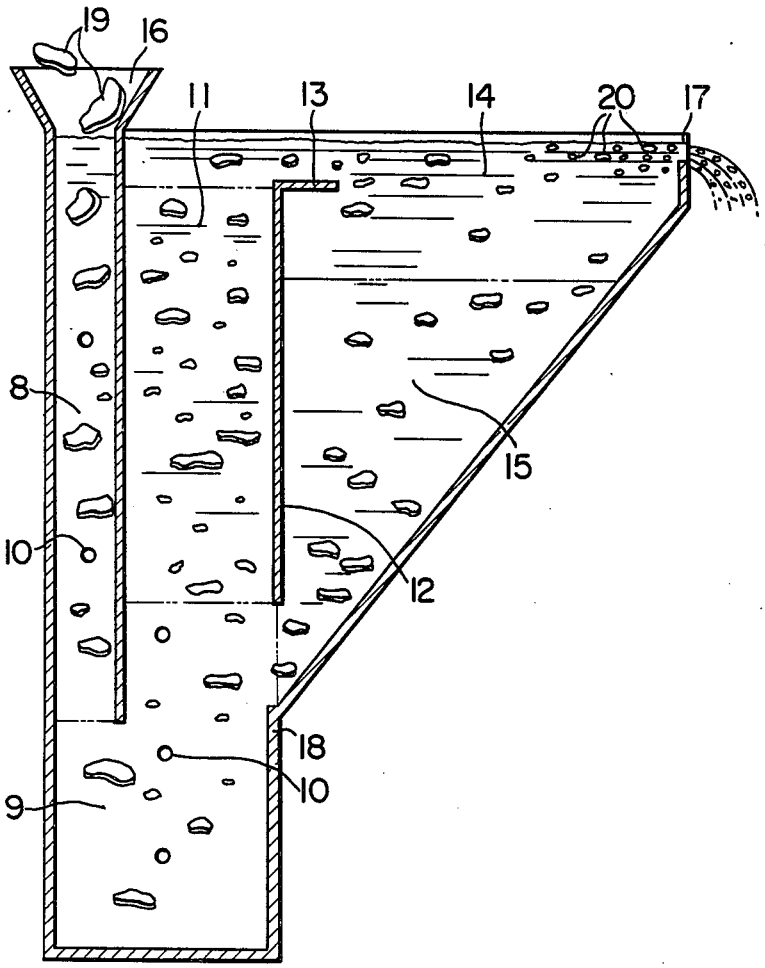
FIG. 2 is a longitudinal sectional view of an apparatus according to this invention.

FIG. 2 is a longitudinal sectional view of one example of apparatus according to this invention. In FIG. 2, mica flakes 19 are charged from mica flake inlet 16 and pass through the coarse size reduction zone 8, the size reduction zone 9, the vertical classification zone 11 and the horizontal classification zone 14 in the size reduction tank 18 and are taken out from mica scale outlet 17 as a slurry. In the coarse size reduction zone 8 and the size reduction zone 9, the size of mica flakes is reduced coarsely at first and then intermediately or finely by high-pressure jets of water introduced through nozzles 10. Mica flakes 19 arrived at the horizontal classification zone 14 together with mica scales 20 are returned to the size reduction zone 9 via the settling zone 15. The vertical classification zone 11 and the settling zone 15 are divided by a water stream controlling plate 12. It is preferable to place a horizontal water stream controlling plate 13 at the top of the water stream controlling plate 12.

In this case, the size reduction tank of this invention comprises (1) the coarse size reduction zone wherein mica flakes charged from the inlet are disintegrated coarsely by complicated force of high-pressure jets of water introduced through one or more nozzles while settling to the bottom through the aqueous solution, (2) the size reduction zone wherein the coarsely disintegrated mica flakes are further disintegrated to mica scales by complicated force of high-pressure jets of water introduced through two or more nozzles, (3) the vertical classification zone wherein the mica scales disintegrated thinly to have sufficient thinness as a commercial product are roughly separated from mica flakes insufficiently disintegrated along an upwardly rising water stream jetted from the nozzles, (4) the horizontal classification zone wherein large or thick mica flakes sink and are separated along a horizontal stream, and (5) the settling zone (or the recovering zone) wherein the large or thick mica flakes sunk from the horizontal classification zone are condensed to be supplied to the size reduction zone so as to be disintegrated again.

Figure 3:
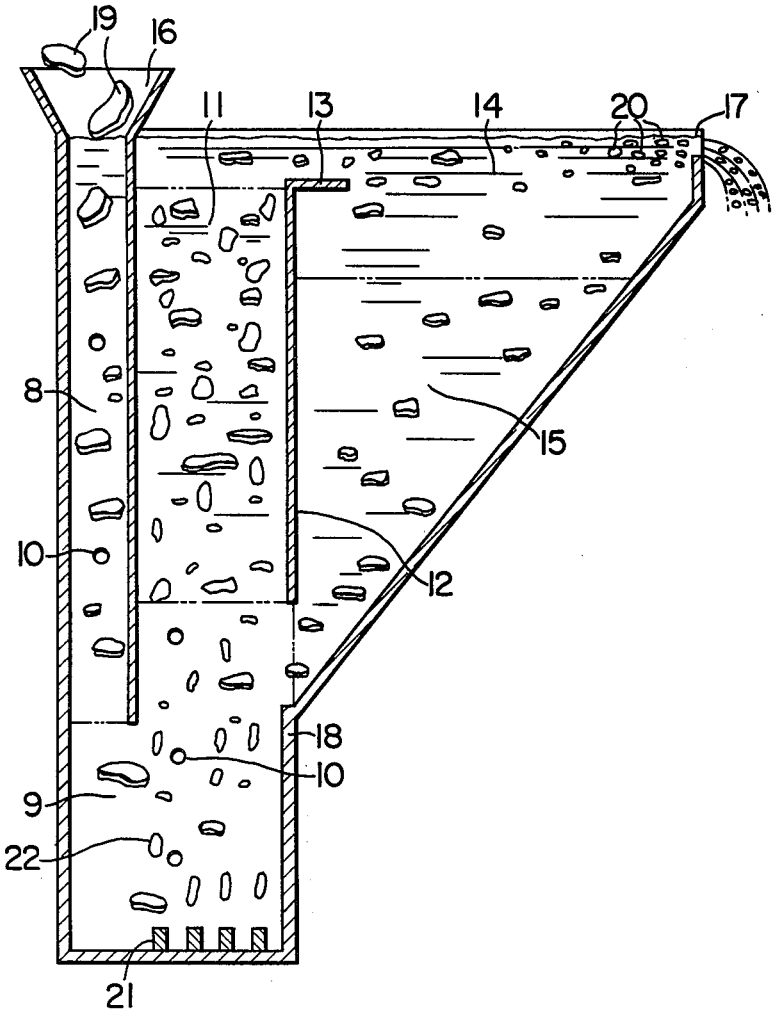
FIG. 3 is a longitudinal sectional view of a modified apparatus according to this invention.

Another example of the apparatus of this invention is shown in FIG. 3. The apparatus of FIG. 3 is modified from that of FIG. 2 by installing one or more nozzles for introducing high-pressure jets of gas therethrough at the bottom of the size reduction zone. That is, in FIG.

3, mica flakes 19 are coarsely disintegrated in the coarse size reduction zone 8 by high-pressure jets of water introduced through one or more nozzles 10, and the coarsely disintegrated mica flakes are further disintegrated by high-pressure jets of water introduced through two or more nozzles 10 and high-pressure jets of gas introduced through one or more nozzles 21 in the size reduction zone 9 and move upwards. In this respect, the method used in the apparatus of FIG. 3 is different from that used in the apparatus of FIG. 2.

Therefore, the apparatus of FIG. 3 is different from that of FIG. 2 in the following zone:

(2) the size reduction zone wherein the coarsely disintegrated mica flakes are further disintegrated to mica scales by complicated force of water streams caused by high-pressure jets of water introduced through two or more nozzles and high-pressure jets of gas introduced through one or more nozzles.

In the above FIGS. 2 and 3, alternate long and two short dashes lines show the approximate borders of individual zones.

By introducing high-pressure jets of gas through the nozzles into the size reduction zone, closing of the passages by mica flakes are prevented and returning of nondisintegrated mica flakes from the settling zone to the size reduction zone is also accelerated.

According to the method of this invention, it is a main object of the coarse size reduction zone to reduce in size large or relatively large mica flakes to smaller mica flakes, even though a small amount of mica flakes may be disintegrated into mica scales and said smaller mica flakes will prevent closing of the passages in the size reduction zone by large mica flakes. It is a main object of the size reduction zone to reduce in size mica flakes to mica scales. According to the method of this invention, the size reduction of mica flakes to mica scales can effectively be conducted by passing the mica flakes through the coarse size reduction zone and the size reduction zone.

This invention will be explained by way of the following examples, which are illustrative and do not limit the scope of this invention.

EXAMPLE 1

To a size reduction tank 18 as shown in FIG. 2 having a volume of about 60 liters, mica flakes 19 were charged from inlet 16 at a rate of 30 kg/hour. The mica flakes were disintegrated by high-pressure jets of water having a water pressure of 25 kg/cm$^2$ and an introducing rate of 40 l./min introduced through one nozzle 10 in the coarse size reduction zone 8 and through three nozzles 10 in the size reduction zone 9, each nozzle having a diameter of 2 mm. Consequently, a slurry containing mica scales 20 having an average size of 0.9 mm and average thickness of 3.3 microns was obtained. Since the volume of the size reduction zone 9 was about 4 liters, an average residence time of the mica flakes 19 and the mica scales 20 in the size reduction zone 9 was calculated as about 6 seconds.

EXAMPLE 2

To a size reduction tank 18 as shown in FIG. 2 having a volume of about 120 liters, mica flakes 19 were charged from inlet 16 at a rate of 108 kg/hour. The mica flakes were disintegrated by high-pressure jets of water having a water pressure of 50 kg/cm$^2$ and an introducing rate of 120 l./min introduced through two nozzles 10 in the coarse size reduction zone 8 and through six nozzles 10 in the size reduction zone 9, each nozzle having a diameter of 2 mm. Consequently, a slurry containing mica scales 20 having an average size of 0.45 mm and average thickness of 4.2 microns was obtained. Since the volume of the size reduction zone 9 was about 8 liters, an average residence time of the mica flakes 19 and the mica scales 20 in the size reduction zone 9 was calculated as about 6 seconds.

EXAMPLE 3

To a size reduction tank 18 as shown in FIG. 2 having a volume of about 300 liters, mica flakes 19 were charged from inlet 16 at a rate of 126 kg/hour. The mica flakes were disintegrated by high-pressure jets of water having a water pressure of 10 kg/cm$^2$ and an introducing rate of 330 l./min introduced through four nozzles 10 in the coarse size reduction zone 8 and through twelve nozzles 10 in the size reduction zone 9, each nozzle having a diameter of 3 mm. Consequently, a slurry containing mica scales 20 having an average size of 1.9 mm and average thickness of 4.2 microns was obtained. Since the volume of the size reduction zone 9 was about 12 liters, an average residence time of the mica flakes 19 and the mica scales 20 in the size reduction zone 9 was calculated as about 2.2 seconds.

EXAMPLE 4

To a size reduction tank 18 as shown in FIG. 2 having a volume of about 200 liters, mica flakes 19 were charged from inlet 16 at a rate of 168 kg/hour. The mica flakes were disintegrated by high-pressure jets of water having a water pressure of 40 kg/cm$^2$ and an introducing rate of 260 l./min introduced through two nozzles 10 in the coarse size reduction zone 8 and through six nozzles 10 in the size reduction zone 9, each nozzle having a diameter of 3 mm. Consequently, a slurry containing mica scales 20 having an average size of 3.2 mm and average thickness of 5.0 microns was obtained. Since the volume of the size reduction zone 9 was about 8 liters, an average residence time of the mica flakes 19 and the mica scales 20 in the size reduction zone 9 was calculated as about 1.2 seconds.

EXAMPLE 5

To a size reduction tank 18 as shown in FIG. 3 having a volume of about 40 liters, mica flakes 19 were charged from inlet 16 at a rate of 30 kg/hour. The mica flakes were disintegrated by high-pressure jets of water having a water pressure of 25 kg/cm$^2$ and an introducing rate of 90 l./min introduced through one nozzle 10 in the coarse size reduction zone 8 and through three nozzles 10 in the size reduction zone 9, each nozzle having a diameter of about 2 mm, and high-pressure jets of air having an air pressure of 7 kg/cm$^2$ and an introducing rate (based on the standard conditions) of 45 l./min introduced through two nozzles 21 in the size reduction zone 9. Consequently, a slurry containing mica scales 20 having an average size of 0.75 mm and average thickness of 3.8 microns was obtained. Since the volume of the size reduction zone 9 was about 3 liters, an average residence time of the mica flakes 19 and the mica scales 20 in the size reduction zone 9 was calculated as about 1.3 seconds.

EXAMPLE 6

To a size reduction tank 18 as shown in FIG. 3 having a volume of about 60 liters, mica flakes 19 were charged from inlet 16 at a rate of 60 kg/hour. The mica flakes were disintegrated by high-pressure jets of water having a water pressure of 30 kg/cm$^2$ and an introducing rate of 120 l./min introduced through two nozzles 10 in the coarse size reduction zone 8 and through six nozzles 10 in the size reduction zone 9, each nozzle having a diameter of about 2 mm, and high-pressure jets of nitrogen gas having a gas pressure of 2 kg/cm$^2$ and an introducing rate (based on the standard conditions) of 60 l./min introduced through four nozzles 21 in the size reduction zone 9. Consequently, a slurry containing mica scales 20 having an average size of 1.4 mm and average thickness of 4.9 microns was obtained. Since the volume of the size reduction zone 9 was about 5 liters, an average residence time of the mica flakes 19 and the mica scales 20 in the size reduction zone 9 was calculated as about 1.7 seconds.

EXAMPLE 7

To a size reduction tank 18 as shown in FIG. 3 having a volume of about 90 liters, mica flakes 19 were charged from inlet 16 at a rate of 120 kg/hour. The mica flakes were disintegrated by high-pressure jets of water having a water pressure of 75 kg/cm$^2$ and an introducing rate of 160 l./min introduced through two nozzles 10 in the coarse size reduction zone 8 and through six nozzles 10 in the size reduction zone 9, each nozzle having a diameter of about 2 mm, and high-pressure jets of nitrogen gas having a gas pressure of 20 kg/cm$^2$ and an introducing rate (based on the standard conditions) of 80 l./min introduced through four nozzles 21 in the size reduction zone 9. Consequently, a slurry containing mica scales 20 having an average size of 1.83 mm and average thickness of 7.3 microns was obtained. Since the volume of the size reduction zone 9 was about 8 liters, an average residence time of the mica flakes 19 and the mica scales 20 in the size reduction zone 9 was calculated as about 2 seconds.

According to this invention, the volume expansion of mica flakes as taught by Japan Pat. application Kokoku No. 15351/60 is not necessary. Since a classification vessel is combined with a size reduction tank to form one apparatus according to this invention, it is not necessary to prepare classification equipment besides a size reduction tank, as taught by U.S. Pat. No. 2,405,576, and also unnecessary to charge again into a size reduction tank large mica flakes which involve much water and are very difficult to be handled. Further since the apparatus of this invention has the coarse size reduction zone, size reduction conditions can be changed depending on the state of raw mica flakes to conduct effective size reduction. In addition, by introducing gas jets into the size reduction zone, there are obtained many advantages in that the water stream can be strengthened, closing of the passages by mica flakes can be prevented, classification efficiency in the vertical classification zone can be increased by the rising gas, average size and average thickness of mica scales in the resulting slurry can be controlled to the desired values, and the like. Since the average residence time in the size reduction zone is short as mentioned in the above Examples, superfluous size reduction of thinly delaminated mica scales to fine particles can be prevented. The apparatus of this invention is constructed as mentioned above, so that the size of mica scales in the resulting slurry can be controlled to have a ratio of diameter/thickness in the range of about 100–1000. In the above-mentioned Examples, the ratio of diameter/thickness of the mica scales is about 500, which is a very desirable value.

Size and thickness of mica scales desired are different depending on uses of reconstituted mica products obtained by processing mica paper. According to this invention, it is possible to produce a slurry of mica scales having suitable size and thickness as well as suitable concentration for producing the desired mica products by controlling the pressure and introducing rate of high-pressure jets of water, the pressure and introducing rate of high-pressure jets of gas, and controlling the water stream through the both classification zones.

As mentioned above, the method of this invention has many advantages comparing with the conventional size reduction methods.

What is claimed is:

1. A method for producing mica scales reduced in size from mica flakes which comprises bringing about coarse size reduction followed by size reduction of mica flakes by high-pressure jets of water, separating mica scales from mica flakes by vertical classification followed by horizontal classification, and taking out the mica scales as a slurry while recycling nondisintegrated mica flakes to size reduction.

2. A method according to claim 1, which further comprises bringing about the size reduction of mica flakes by high-pressure jets of gas together with high-pressure jets of water.

3. A method according to claim 1 or 2, wherein water pressure of the high-pressure jets of water is 10 to 100 kg/cm$^2$.

4. A method according to claim 2, wherein gas pressure of the high-pressure jets of gas is 2 to 30 kg/cm$^2$.

5. A method according to claim 2 or 4, wherein the gas is an inert gas or air.

6. An apparatus for the size reduction of mica flakes to produce mica scales comprising a coarse size reduction zone and a size reduction zone connected thereto, both zones installing nozzles for introducing high-pressure jets of water in order to disintegrate the mica flakes, a vertical classification zone wherein the mica flakes and mica scales moved from the size reduction zone are separated along an upward stream of water, a horizontal classification zone connected to the vertical classification zone wherein the mica scales are separated from the mica flakes along a horizontal stream of water, and a settling zone wherein nondisintegrated mica flakes settled from the horizontal classification zone are returned to the size reduction zone.

7. An apparatus according to claim 6, which further comprises one or more nozzles for introducing high-pressure jets of gas installed in the size reduction zone.

* * * * *